US006497005B2

(12) United States Patent
Apostoloff

(10) Patent No.: US 6,497,005 B2
(45) Date of Patent: Dec. 24, 2002

(54) HINGE MOUNTED ADJUSTABLE DOORSTOP

(76) Inventor: David J Apostoloff, 22 Wayne Dr., Derry, NH (US) 03038

( * ) Notice: Subject to any disclaimer, the term of this patent is extended or adjusted under 35 U.S.C. 154(b) by 0 days.

(21) Appl. No.: 09/815,522

(22) Filed: Mar. 23, 2001

(65) Prior Publication Data

US 2002/0133909 A1 Sep. 26, 2002

(51) Int. Cl.[7] ..... E05D 11/06; E05F 5/02
(52) U.S. Cl. ..... 16/375; 16/82; 292/341.18
(58) Field of Search ..... 16/375, 374, 82, 16/86 B, 50, 377; 292/288, 297, 298, 340, 341.18, 343

(56) References Cited

U.S. PATENT DOCUMENTS 2,930,075 A * 3/1960 Deutchman et al. ..... 16/375
3,325,854 A * 6/1967 Steigerwald ..... 16/375
3,333,294 A * 8/1967 Warner ..... 16/375
3,602,942 A * 9/1971 Neff et al. ..... 16/375
3,913,171 A * 10/1975 Reid ..... 16/342
3,971,100 A * 7/1976 Anop ..... 16/223
4,259,762 A * 4/1981 Civitelli ..... 16/85
4,738,002 A * 4/1988 Shank ..... 16/223
5,265,922 A * 11/1993 Falcone ..... 16/375
5,539,954 A * 7/1996 Ambar ..... 16/82
5,649,339 A * 7/1997 Reed ..... 16/50

* cited by examiner

*Primary Examiner*—Chuck Y. Mah
(74) *Attorney, Agent, or Firm*—Joseph E. Funk

(57) ABSTRACT

An adjustable doorstop is disclosed that mounts on a hinge pin that is inserted into mating hinge leafs. The doorstop has two members that are manually positioned with respect to each other and lock to set how far the door to which they are mounted can open. The doorstop members each have a means that contact only a hinge leaf of a door hinge to prevent a door from opening beyond its manually predetermined point.

8 Claims, 3 Drawing Sheets

HINGE MOUNTED ADJUSTABLE DOORSTOP

FIELD OF THE INVENTION

This invention relates to the field of doorstop devices. More particularly, this invention relates to doorstops of the type that are mounted on the hinge pin of a door and prevent the door from being opened beyond a manually preset point to prevent the door from hitting an adjacent wall when it is opened. Even more particularly this invention relates to an adjustable hinge pin mounted doorstop.

BACKGROUND OF THE INVENTION

Hinged doors must frequently be limited in their movement to prevent them banging walls and furniture. The prior art teaches a variety of solutions, both simple and complex, to limit the distance a door may be permitted to travel to prevent it from hitting walls and furniture and causing damage thereto.

U.S. Pat. No. 5,237,724 teaches and claims a hinge pin swing doorstop comprised of a hinge pin replacement shaft that replaces the hinge pin in a hinge associated with a hinged object whose hinged rotation is to be limited. The top of the hinge pin replacement shaft extends beyond the hinge and is bent at a right angle with respect to the replacement shaft and is formed into a Vee shape with the Vee lying in a plane generally perpendicular to the axis of the hinge pin portion in the hinge. The end of the Vee shaped portion furthest from the hinge pin replacement shaft is threaded and has an internally threaded, length extending ferrule and a locking nut co-linearly screwed thereon. The outer end of the ferrule has a shock absorbing bumper mounted thereon. By loosening the locking nut and turning the length extending ferrule the length of the outer end of the Vee shaped portion can be lengthened or shortened to adjust how far a door on which the hinge pin swing doorstop taught in this patent can be opened before the shock absorbing bumper contacts the doorframe and prevents the door on which it is mounted from opening further.

U.S. Pat. No. 4,998,941 teaches and claims an adjustable hinge pin mounted doorstop consisting of an arm that has an inner end with a hole through which an existing hinge pin is inserted, and the outer end of the arm terminates in a threaded opening. A door hinge pin is removed, inserted through the inner end hole, and back into the hinge leaf holes to hold the hinge leaves together. A threaded post is received in the threaded opening on the outer end of the arm, and the threaded post has a padded, shocking absorbing bumper thereon that contacts the doorframe and prevents the door from opening beyond a certain point. How far the door can open before the bumper contacts the doorframe is set by how far the threaded post is turned through the threaded opening through the outer end of the arm.

U.S. Pat. Nos. 4,527,303 and 4,858,273 both teach and claim a hinge pin mounted doorstop having multiple mounting holes that are used to adjust how far a door may be opened. A door hinge pin is removed, inserted through one of the multiple mounting holes and back into the hinge leaf holes holding two hinge leaves together in a movable manner as is known in the art. These doorstops each have two shock absorbing bumpers and as the door on which the doorstop is hinge pin mounted is opened to its furthest position, as determined by the doorstop, one of the two bumpers contacts the door and the other of the two bumpers contacts the doorframe. How far the door can be opened before the bumpers contact the door and the doorframe is set by the one of the multiple mounting holes through which the hinge pin is inserted.

U.S. Pat. No. 5,727,289 teaches and claims a hinge mounted adjustable doorstop, but the entire hinge must be replaced, or an existing hinge must be removed and modified. Thus, this adjustable doorstop is more impractical than others taught in the prior art.

The problem with all these prior art hinge pin mounted adjustable doorstops is that they must all contact the wood of the door and the doorframe. If the door is not opened carefully, the relatively small rubber bumpers of the prior art adjustable doorstops place a lot of force on the wood. Depressions are caused in the wood and eventually the rubber bumpers break and exposed metal ends more seriously damage the wood of the door and the doorframe. These prior art doorstops also have another shortcoming. They all have a very limited range of adjustability. That is, the angle of adjustment for stopping the travel of a door is limited.

Thus, there is a need in the prior art for a relatively simple, hinge pin mounted, adjustable doorstop that has no rubber pieces that can wear out and eventually break, that does not contact the wood of a door or doorframe and thereby mar or damage the wood, and that has a wide adjustment range.

SUMMARY OF THE INVENTION

The foregoing need in the prior art for a simple, hinge pin mounted, adjustable doorstop that does not contact the wood of a door or doorframe, and that does not have rubber pieces that can wear out, is satisfied by the present invention.

The present invention is a small, all metal, adjustable doorstop that easily and quickly mounts on the existing hinge pin of a door hinge and only contacts the metal leaves of the door hinge on which the doorstop is mounted to limit the travel of the door on opening. In addition, the present invention permits providing control of how far a door can be opened that is in the order of ninety (90) percent of the normal travel of the door.

DETAILED DESCRIPTION

Figure 1:
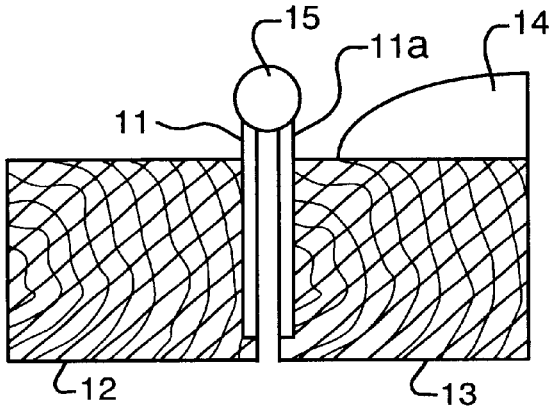
FIG. 1 shows a top view of a hinge on a closed door.

In FIG. 1 is shown a top view of a hinge mounted on a closed door. As is well known in the art, the hinge consists of a leaf piece 11 which is fastened to one edge of a door 12 using screws (not shown) and a leaf piece 11A that is screwed to doorframe 13 using screws (not shown). Hinge leaf pieces 11 and 11A are fastened together with a hinge pin 15 in a well-known manner. Also shown is a molding 14.

Figure 2:
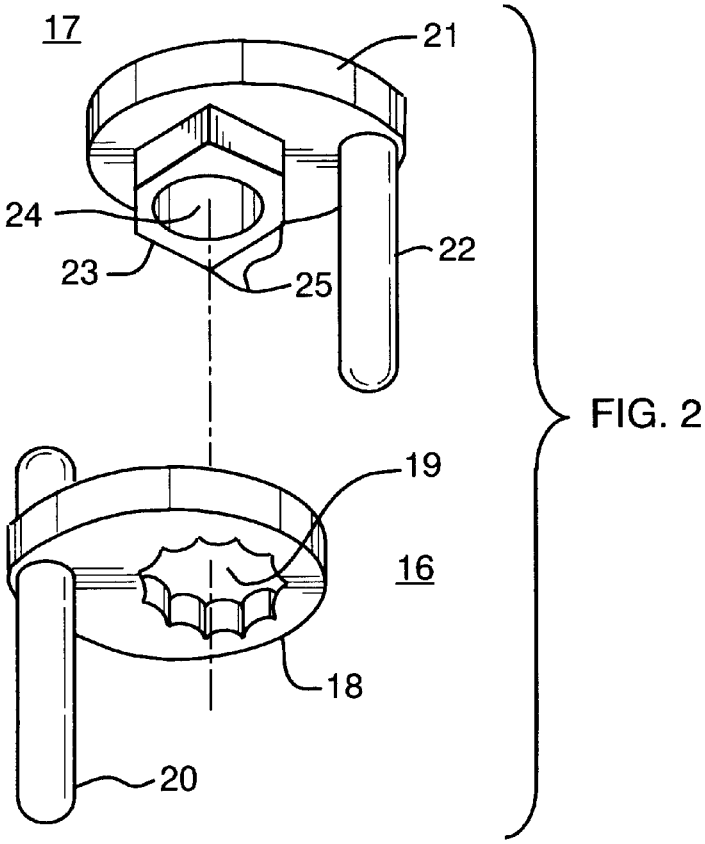
FIG. 2 shows an orthogonal view of my novel adjustable doorstop.
Figure 3:
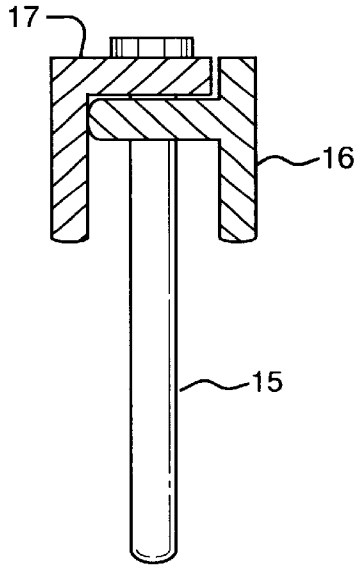
FIG. 3 shows a side view of my novel doorstop mounted on a door hinge pin before the pin is inserted into other change elements to hold them in a rotating orientation.

In FIG. 2 is shown an orthogonal view of my novel, adjustable doorstop that comprises member pieces 16 and 17 that must be oriented as shown when mounted on any hinge pin 15, as shown in FIG. 3. These two member pieces 16 and 17 are preferably fabricated from metal. Piece 16 has an oval shaped, flat portion 18 having a hole 19 therethrough, and the edge 26 around hole 19 is scalloped, as shown, identical to a multi-point box wrench or a multi-point tool socket. Perpendicular to the plane of flat portion 18 is an elongated member 20. While member 20 is shown with a circular cross-section, it's cross-sectional shape may be oval or any other shape as is convenient.

Piece 17 also consists of an oval shaped flat piece 21 that has an elongated member 22 perpendicular to the plane of piece 21. There is also a hole through the widest portion of flat piece 21 over which there is affixed a nut shaped element 23. Element 23 has a smooth hole 24 through its center that has a diameter only slightly larger than the diameter of the shaft portion of a hinge pin 15. The six tips 25 of nut shaped element 23 fit perfectly inside the scallop shaped edges 26 around hole 19 in the identical same manner as a proper size box wrench or socket fits over a nut.

In FIG. 3 is shown a side view of my novel, adjustable doorstop mounted on a door hinge pin 15 before the pin is inserted into hinge leaves 11 and 11A to hold them in a rotating orientation. Once adjustable doorstop member pieces 16 and 17 are fitted together as shown in FIG. 3, they remain in a fixed orientation that can only be changed by removing the nut shaped portion 23 from scalloped shaped edges 26 around hole 19, as shown in FIG. 2, rotating one or both of the pieces 16 and 17 with respect to each other and reinserting nut shaped portion 23 back into scalloped hole 19.

With my novel, adjustable doorstop mounted on the elongated shaft of hinge pin 15, as shown in FIG. 3, the elongated shaft portion of hinge pin 15 is inserted into the mating portions of hinge leaf pieces 11 and 11A.

Figure 4:
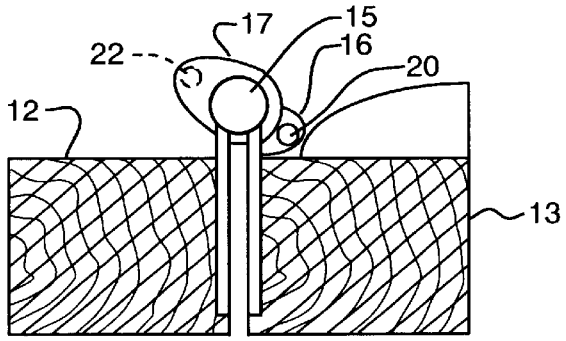
FIG. 4 shows a top view of a closed door with my novel doorstop mounted on the hinge pin.

FIG. 4 shows a top view of a closed door 12 with my novel doorstop mounted on hinge pin 15. When door 12 is closed elongated member 22 of piece 17 is positioned generally as shown. At the same time elongated member 20 of piece 16 is positioned up against hinge piece 11A as shown.

Figure 5:
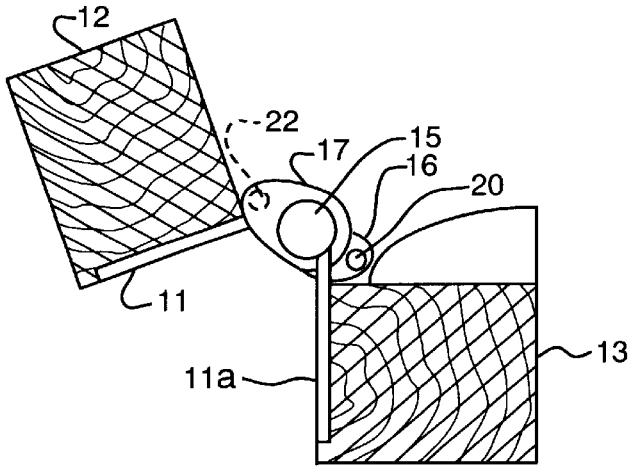
FIG. 5 shows a top view of an open door with my novel doorstop mounted on the hinge pin, with the door open as far as the doorstop will permit.
Figure 6:
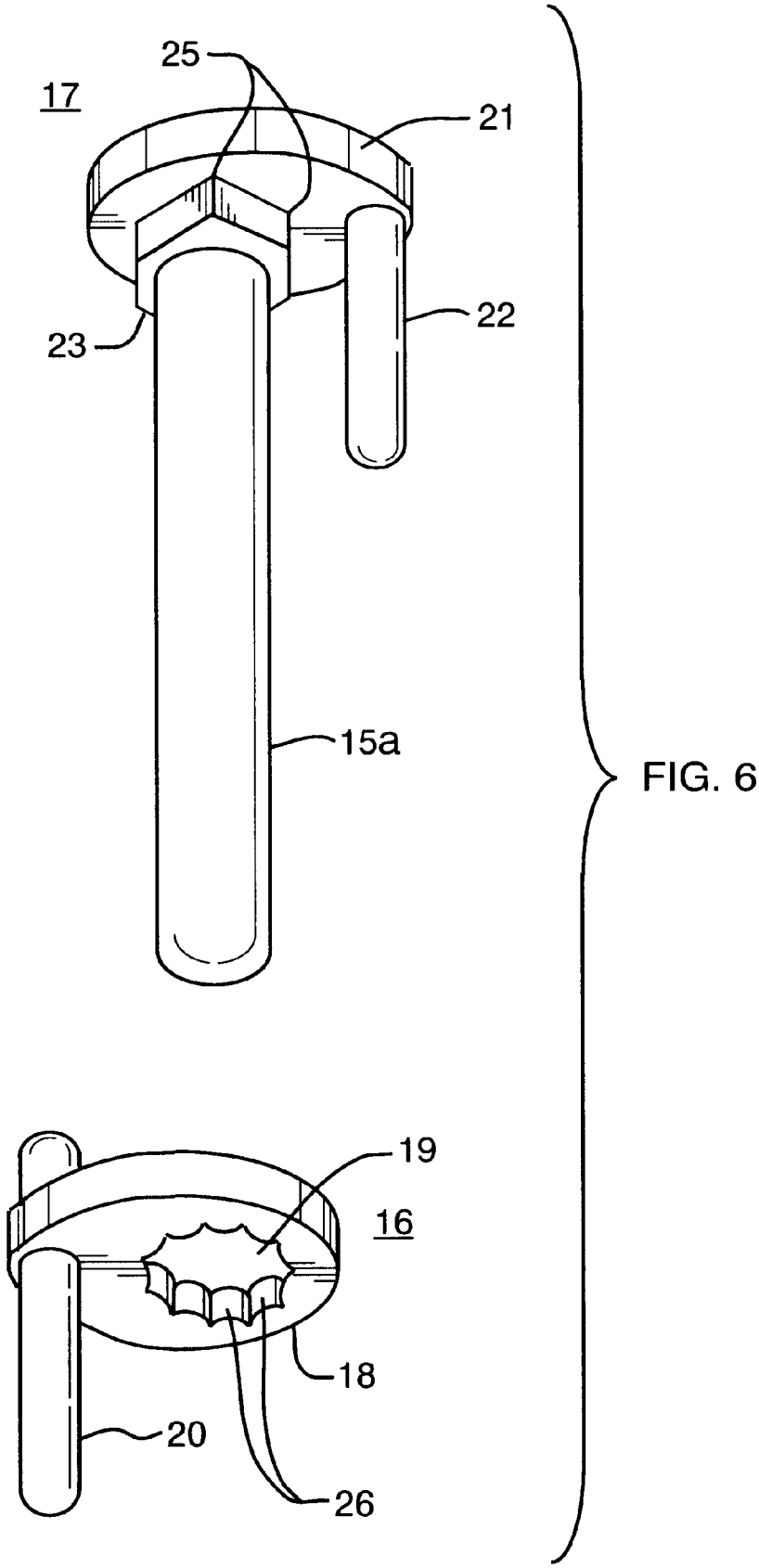
FIG. 6 shows an orthogonal view of my novel adjustable doorstop with an integral hinge pin as part thereof.

FIG. 5 shows a top view of an open door 13 with my novel doorstop mounted on the hinge pin 15, with door 12 open as far as the doorstop will permit. With elongated member 20 of doorstop piece 16 sitting against hinge leaf 11A, door 12 can rotate open until its hinge leaf 11 comes into contact with elongated member 22 of doorstop piece 17. Door 12 can open no further. With this operation there is no piece of my novel adjustable doorstop that comes into contact with the wooden portion of door 12 or doorframe 13.

In viewing FIGS. 4 and 5 it will be obvious that doorstop pieces 16 and 17 can be oriented with respect to each other so that door 12 can barely open, or can open almost all its normal travel when no door stop is provided.

While what has been disclosed hereinabove is the preferred embodiment of the invention, it will be obvious to those skilled in the art that numerous changes may be made without departing from the spirit and scope of the invention. For instance, the cross sectional shape of elongated members 20 and 22 can be changed to have a flat side that will sit flat on the hinge leaf they come into contact with. In addition, the number of points in scalloped edges 26 around hole 19 of hinge piece 16 can be increased to provide a greater number of positions to which my adjustable doorstop can be set.

What I claim is:

1. An adjustable doorstop for use with a prior art hinge that is used to mount a door to a doorframe, the hinge having a first hinge leaf connected to the door, a second hinge leaf connected to a doorframe, and a hinge pin joining the first and the second hinge leafs, said adjustable doorstop comprising:

a first member with a hole to receive the hinge pin therethrough, said first member having (i) a first locking means, and (ii) first stopping means that can only contact the first hinge leaf;

a second member having a hole to receive the hinge pin therethrough, said second member having (i) a second locking means, (ii) second stopping means that can only contact the second hinge leaf; and wherein said first locking means and said second locking means may be manually positioned with respect to each other and they cooperate to determine how far the door may be opened, and when said first stopping means contacts said first hinge leaf and said second stopping means contacts said second hinge leaf the door is open as far as said adjustable door stop will permit the door to open.

2. The adjustable doorstop in accordance with claim 1 wherein said first stopping means contacts said first hinge leaf and said second stopping means contacts said second hinge leaf when said door is opened as far as it is allowed to open by said adjustable doorstop.

3. The adjustable doorstop in accordance with claim 2 wherein said first locking means engages said second locking means to prevent said first member from rotating with respect to said second member when they are both mounted on said hinge pin and said hinge pin is fully inserted into said first and said second hinge leafs.

4. The adjustable doorstop in accordance with claim 3 wherein to adjust how far said door may be opened using said adjustable doorstop, said hinge pin is at least partially withdrawn from said first and said second hinge leafs to permit said first locking means and said second locking means to be disengaged from each other and be rotated to a new position before again being re-engaged as said hinge pin is fully inserted into said first and said second hinge leafs.

5. The adjustable doorstop in accordance with claim 4 wherein said first and said second stopping members are both elongated and lie parallel to said hinge pin and lie alongside the portion of said first and said second hinge leafs into which said hinge pin is inserted.

6. An adjustable doorstop for use with a prior art hinge that is used to mount a door to a doorframe and has a first hinge leaf connected to the door, a second hinge leaf connected to the doorframe and a hinge pin joining said first and said second hinge leafs, said adjustable doorstop comprising:

a first member having an elongated portion, and said first member having (i) a first locking means, and (ii) a first stopping means that can only contact said first hinge leaf;

a second member having (i) a hole to receive said elongated portion of said first member therethrough, (ii) a second locking means, and (iii) a second stopping means that can only contact said second hinge leaf; and wherein said first locking means and said second locking means may be manually positioned with respect to each other and they cooperate to determine how far the door may be opened when the door is opened as wide as it is allowed using said adjustable doorstop, and wherein said elongated portion of said first member replaces the prior art hinge pin to hold the first and the second hinge leafs together in a rotating fashion.

7. The adjustable doorstop in accordance with claim 6 wherein said first stopping means contacts said first hinge leaf and said second stopping means contacts said second hinge leaf when said door is opened as far as it is allowed to open by said adjustable doorstop.

8. The adjustable doorstop in accordance with claim 7 wherein said first locking means engages said second locking means to prevent said first member from rotating with respect to said second member when said second member is mounted on said elongated member of said first member and said elongated member is fully inserted into said first and said second hinge leafs in lieu of said hinge pin.

* * * * *